US007562964B2

(12) United States Patent
Furukawa et al.

(10) Patent No.: US 7,562,964 B2
(45) Date of Patent: Jul. 21, 2009

(54) METHOD OF MANUFACTURING NOZZLE PLATE, NOZZLE PLATE, LIQUID EJECTION HEAD AND IMAGE FORMING APPARATUS

(75) Inventors: Gentaro Furukawa, Kanagawa (JP); Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 595 days.

(21) Appl. No.: 11/448,012

(22) Filed: Jun. 7, 2006

(65) Prior Publication Data

US 2006/0279605 A1 Dec. 14, 2006

(30) Foreign Application Priority Data

Jun. 8, 2005 (JP) ..... 2005-168457

(51) Int. Cl.
*B41J 2/135* (2006.01)

(52) U.S. Cl. ..... 347/45; 347/47

(58) Field of Classification Search ..... 347/45, 347/47

See application file for complete search history.

(56) References Cited

U.S. PATENT DOCUMENTS 5,502,470 A * 3/1996 Miyashita et al. ..... 347/45

FOREIGN PATENT DOCUMENTS

JP 9-267478 A 10/1997
JP 2002-187267 A 7/2002

* cited by examiner

*Primary Examiner*—Thinh H Nguyen
(74) *Attorney, Agent, or Firm*—Birch, Stewart, Kolasch & Birch, LLP

(57) ABSTRACT

The method manufactures a nozzle plate. The method comprises: a liquid-repelling film forming step of forming a liquid-repelling film on an entire surface of a nozzle plate forming substrate having been formed with nozzles for ejecting liquid droplets; a liquid-repelling film solidification step of solidifying the liquid-repelling film formed in the liquid-repelling film forming step on a liquid droplet ejection surface of the nozzle plate forming substrate; a liquid-philic film forming step of forming a liquid-philic film on the liquid-repelling film formed on the entire surface of the nozzle plate forming substrate, after the liquid-repelling film solidification step; a liquid-philic film solidification step of solidifying the liquid-philic film formed in the liquid-philic film forming step; and a liquid-philic film removal step of removing the liquid-philic film formed on the liquid-repelling film on the liquid droplet ejection surface of the nozzle plate forming substrate, after the liquid-philic film solidification step.

6 Claims, 6 Drawing Sheets

METHOD OF MANUFACTURING NOZZLE PLATE, NOZZLE PLATE, LIQUID EJECTION HEAD AND IMAGE FORMING APPARATUS

BACKGROUND OF THE INVENTION

1. Field of the Invention

The present invention relates to a method of manufacturing a nozzle plate, a nozzle plate, a liquid ejection head, and an image forming apparatus, and more particularly, to a method of manufacturing a nozzle plate, a nozzle plate, a liquid ejection head and an image forming apparatus, in which a liquid-repelling film is formed on the surface of a nozzle plate on the liquid droplet ejection side thereof, and a liquid-philic film is formed on the other parts of the nozzle plate.

2. Description of the Related Art

Print heads installed in an inkjet type of image forming apparatus include heads provided with a nozzle plate on a surface opposing the recording medium, in which liquid droplets (ink droplets) are ejected toward the recording medium from a plurality of nozzles formed in the nozzle plate.

A nozzle plate is known in the related art in which a liquid-repelling film is formed on the liquid droplet ejection surface of the nozzles plate, in order to stabilize the direction of flight of the liquid droplets ejected from the nozzles and to stabilize the meniscus of the ink in the nozzle, and a liquid-philic film is formed on the other parts of the nozzle plate (for example, the inner walls of the nozzles), in order to improve the ink supply performance and to facilitate control of the back pressure.

In the present specification, the term "liquid-philic" means "having a strong affinity for the liquid (e.g., the ink)". For example, in the case where the liquid or the ink is an aqueous solution or water-based, the terms "liquid-philic" and "liquid-philicity" correspond to "hydrophilic" and "hydrophilicity", respectively. On the other hand, in the case where the liquid or the ink is an oleaginous solution or oil-based, the terms "liquid-philic" and "liquid-philicity" correspond to "oleophilic" and "oleophilicity".

For example, Japanese Patent Application Publication No. 9-267478 discloses a method of manufacturing a nozzle plate in which a water-repelling and oil-repelling film is formed over the entire surface of the nozzle plate, silicone rubber is bonded onto the water-repelling and oil-repelling film on the front surface of the nozzle plate, and the plate is exposed to oxygen plasma, whereby the water-repelling and oil-repelling film on the parts other than the front surface is removed thus making those parts hydrophilic and oleophilic.

Japanese Patent Application Publication No. 2002-187267 discloses a method of manufacturing a nozzle plate in which a liquid-repelling film is formed on the whole surface of a nozzle plate, whereupon the front surface of the nozzle plate is sealed with a resist, the liquid-repelling film that is not covered with the resist is removed, a liquid-philic film is formed on the surface where the liquid-repelling film has been removed, and finally, the resist is removed.

However, the oxygen plasma processing in Japanese Patent Application Publication No. 9-267478 does not produce sufficient liquid-philicity, and moreover, the produced liquid-philicity deteriorates with the passage of time. Furthermore, since the interface between the base material and the liquid-repelling film makes contact with the ink, then there may be erosion at the interface and corrosion of the base material.

On the other hand, in Japanese Patent Application Publication No. 2002-187267, since the whole surface of the nozzle plate is covered with the liquid-repelling film and the liquid-philic film, then the problems associated with Japanese Patent Application Publication No. 9-267478 do not occur. However, the manufacturing method requires steps for removing the liquid-repelling film and the resist, and the like, and this makes the manufacturing process more complicated. For example, if etching is performed to remove the liquid-repelling film, then it is difficult to achieve uniform reaction speed and churning of the solvent and the etching depth of the resist, between the nozzles, and this gives rise to ejection nonuniformity between the nozzles. Moreover, blasting and ashing, and the like, are also possible methods for removing the liquid-repelling film; however, it is difficult with these methods to uniformly remove the liquid-repelling film at all of the nozzles without damaging the base material. Further, it is also possible to form a liquid-repelling film that is readily removable, by adjusting the composition of the liquid-repelling film; however, the liquid-repelling film of this kind would have weak resistance to scratching and the action of chemicals, thus leading to deterioration in production specifications. Furthermore, in a method which uses mask processing with a resist, an interface between the liquid-repelling film and the liquid-philic film becomes present inside the nozzle, and the interface does not coincide with the meniscus position formed at the opening section of the nozzle, and hence it can lead to deterioration in the ink supply performance, as well as making the control of the back pressure more difficult.

SUMMARY OF THE INVENTION

The present invention has been contrived in view of the aforementioned circumstances, an object thereof being to provide a method of manufacturing a nozzle plate having a simplified manufacturing process in which the steps of removing liquid-repelling film, resist, and the like, are eliminated.

In order to attain the aforementioned object, the present invention is directed to a method of manufacturing a nozzle plate, comprising: a liquid-repelling film forming step of forming a liquid-repelling film on an entire surface of a nozzle plate forming substrate having been formed with nozzles for ejecting liquid droplets; a liquid-repelling film solidification step of solidifying the liquid-repelling film formed in the liquid-repelling film forming step on a liquid droplet ejection surface of the nozzle plate forming substrate; a liquid-philic film forming step of forming a liquid-philic film on the liquid-repelling film formed on the entire surface of the nozzle plate forming substrate, after the liquid-repelling film solidification step; a liquid-philic film solidification step of solidifying the liquid-philic film formed in the liquid-philic film forming step; and a liquid-philic film removal step of removing the liquid-philic film formed on the liquid-repelling film on the liquid droplet ejection surface of the nozzle plate forming substrate, after the liquid-philic film solidification step.

According to the present invention, a liquid-repelling film is formed on the liquid droplet ejection surface of the nozzle plate forming substrate, by means of a simple manufacturing process which includes no steps for removing the liquid-repelling film or resist. More over, it is possible to manufacture the nozzle plate having the liquid-philic film formed on the parts other than the liquid droplet ejection surface.

Preferably, the liquid-repelling film has a property of solidifying when irradiated with radiation; the liquid-repelling film solidification step includes a step of solidifying the liquid-repelling film by irradiating the radiation onto the liquid-repelling film formed on the liquid droplet ejection surface of the nozzle plate forming substrate; and the liquid-philic film solidification step includes a step of thermally curing the liquid-philic film formed on the liquid-repelling film.

According to this aspect of the present invention, it is possible to form the liquid-philic film up to the vicinity of the meniscus position on the inside of the nozzles, and the positions at which the liquid-philic film is formed are substantially uniform between the plurality of nozzles. Therefore, liquid ejection characteristics and liquid supply performance are improved, and control of the back pressure is facilitated. Here, the "radiation" includes ultraviolet light, an electron beam, and the like.

Preferably, the liquid-repelling film solidification step includes a step of causing the liquid-repelling film formed on the liquid droplet ejection surface of the nozzle plate forming substrate to assume a semi-solidified state, and then changing the liquid-repelling film to a fully solidified state by irradiating the radiation onto the liquid-repelling film.

According to this aspect of the present invention, the adhesion of the liquid-philic film to the liquid-repelling film formed on the parts other than the liquid droplet ejection surface of the nozzle plate forming substrate, is improved.

In order to attain the aforementioned object, the present invention is also directed to a nozzle plate, comprising: a nozzle plate forming substrate which has nozzles for ejecting liquid droplets; a liquid-repelling agent which is applied on an entire surface of the nozzle plate forming substrate, the liquid-repelling agent being in a fully solidified state on a liquid droplet ejection surface side of the nozzle plate forming substrate and being in a semi-solidified state on a surface of the nozzle plate forming substrate opposite to the liquid droplet ejection surface and on inner walls of the nozzles; and a liquid-philic film which is formed on the semi-solidified liquid-repelling agent on the surface opposite to the liquid droplet ejection surface and on the inner walls of the nozzles.

According to the present invention, the adhesion of the liquid-philic film to the liquid-repelling film formed on the opposite side of the nozzle plate forming substrate from the liquid droplet ejection surface, and the inner walls of the nozzles, is improved.

In order to attain the aforementioned object, the present invention is also directed to a liquid ejection head, comprising the above-described nozzle plate.

In order to attain the aforementioned object, the present invention is also directed to an image forming apparatus, comprising the above-described liquid ejection head.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
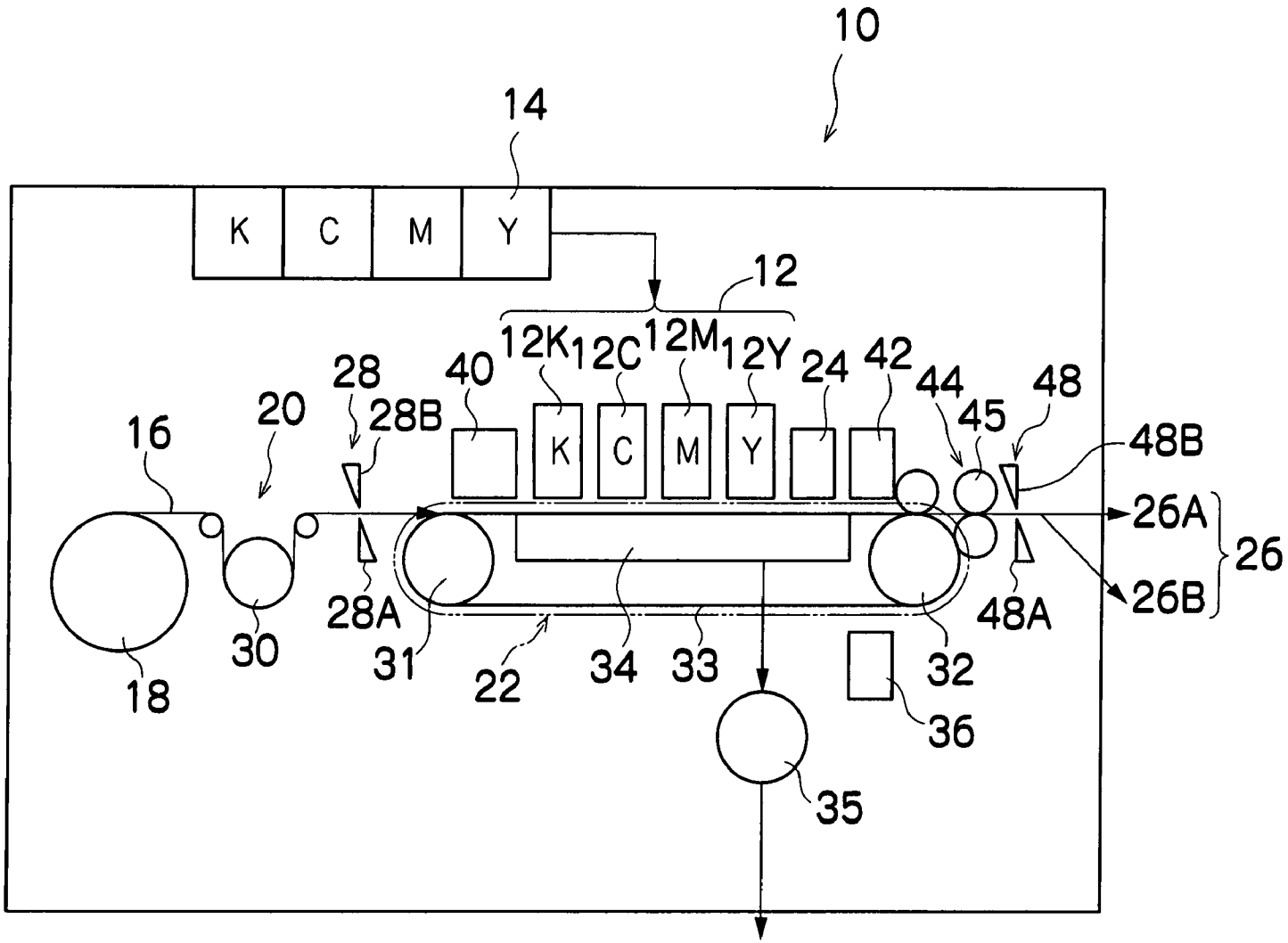
FIG. 1 is a general compositional view showing an inkjet recording apparatus using an inkjet head according to an embodiment of the present invention.

FIG. 1 is a general schematic drawing of an inkjet recording apparatus which forms an image forming apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a flat plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). The print heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, and 12Y are arranged in the order of black (K), cyan (C), magenta (M), and yellow (Y) from the upstream side (the left-hand side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) that is perpendicular to paper conveyance direction.

Although the configuration with the KCMY four standard colors is described in the present embodiment, combinations of the ink colors and the number of colors are not limited to those. Light inks or dark inks can be added as required. For example, a configuration is possible in which inkjet heads for ejecting light-colored inks such as light cyan and light magenta are added. Furthermore, there are no particular restrictions of the sequence in which the print heads of respective colors are arranged.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, 12Y, via a tube channel (not shown). Moreover, the ink storing and loading unit 14 also comprises a notifying device (display device, alarm generating device, or the like) for generating a notification if the remaining amount of ink has become low, as well as having a mechanism for preventing incorrect loading of ink of the wrong color.

The print determination unit 24 shown in FIG. 1 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawings, the paper output unit 26A for the target prints is provided with a sorter for collecting prints according to print orders.

Structure of Print Head

Next, the structure of a print head is described. The print heads 12K, 12M, 12C and 12Y of the respective ink colors have the same structure, and a reference numeral 50 is hereinafter designated to any of the print heads.

Figure 2:
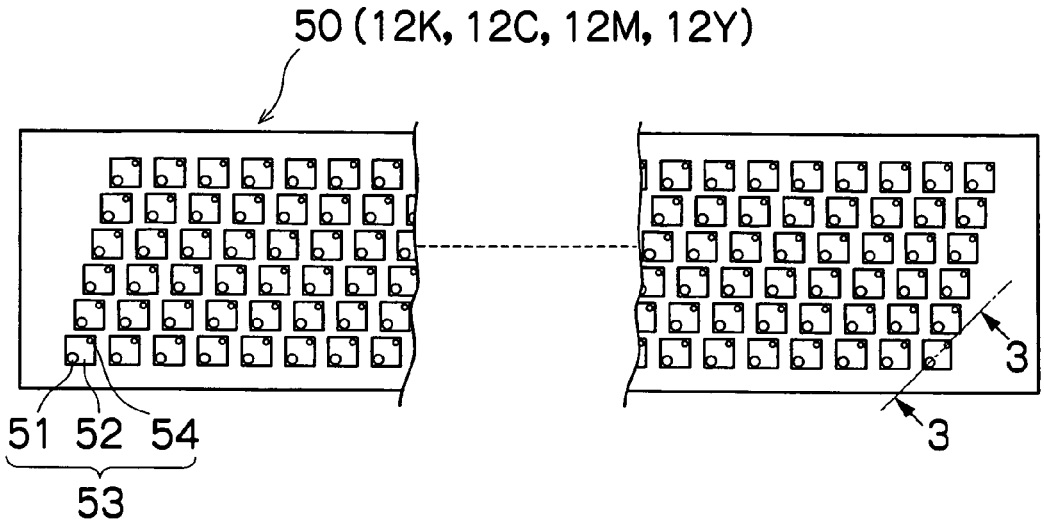
FIG. 2 is a plan perspective diagram showing an embodiment of the structure of a print head.
Figure 3:
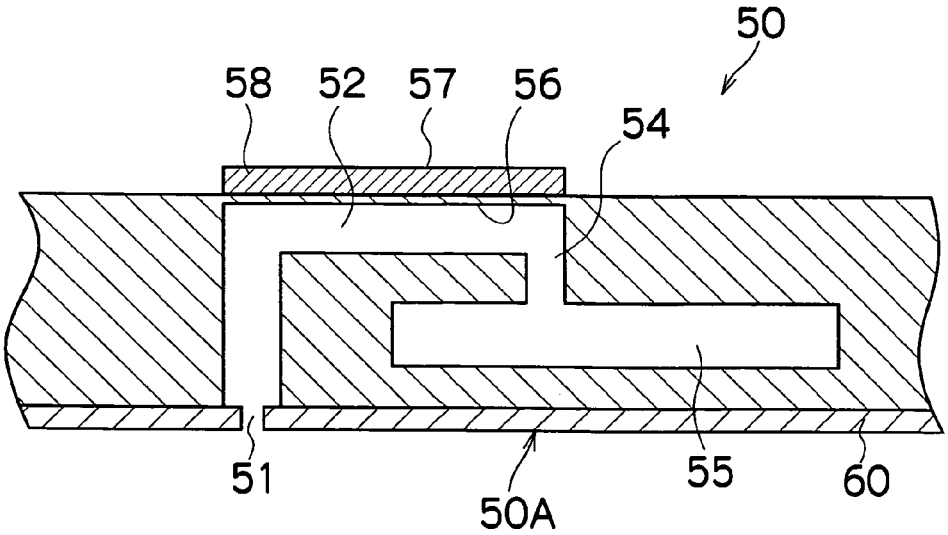
FIG. 3 is a cross-sectional diagram along line 3-3 in FIG. 2.

FIG. 2 is a perspective plan view showing an embodiment of the configuration of the print head 50, and FIG. 3 is a cross-sectional view taken along the line 3-3 in FIG. 2, showing the inner structure of a droplet ejection element (an ink chamber unit for one nozzle 51).

The nozzle pitch in the print head 50 should be minimized in order to maximize the resolution of the dots printed on the surface of the recording paper 16. As shown in FIG. 2, the print head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the print head (the direction perpendicular to the paper conveyance direction) is reduced and high nozzle density is achieved.

As shown in FIGS. 2, the planar shape of the pressure chamber 52 provided for each nozzle 51 is substantially a square, and a nozzle 51 and an inlet of supplied ink (supply port) 54 are disposed in both corners on a diagonal line of the square.

As shown in FIG. 3, the nozzle surface (ink ejection surface) 50A of the print head 50 is constituted by a nozzle plate 60 in which nozzles (nozzle orifices) 51 are formed. The method of manufacturing the nozzle plate 60 is described in detail hereinafter.

Each pressure chamber 52 is connected via a supply port 54 to a common flow channel 55. Furthermore, the common flow channel 55 is connected to an ink tank (not shown), which forms a source of ink. The ink supplied from the ink tank is divided and supplied to the respective pressure chambers 52 via the common flow channel 55.

An actuator 58 provided with an individual electrode 57 is joined to a diaphragm (common electrode) 56 which forms the upper face of each pressure chamber 52, and the actuator 58 is deformed when a drive voltage is supplied to the individual electrode 57, thereby changing the volume of the pressure chamber 52 and causing ink to be ejected from the nozzle 51 by the pressure change in accordance therewith. The actuator 58 is preferably a piezoelectric element. When ink is ejected, new ink is supplied to the pressure chamber 52 from the common flow channel 55 through the supply port 54.

Figure 4:
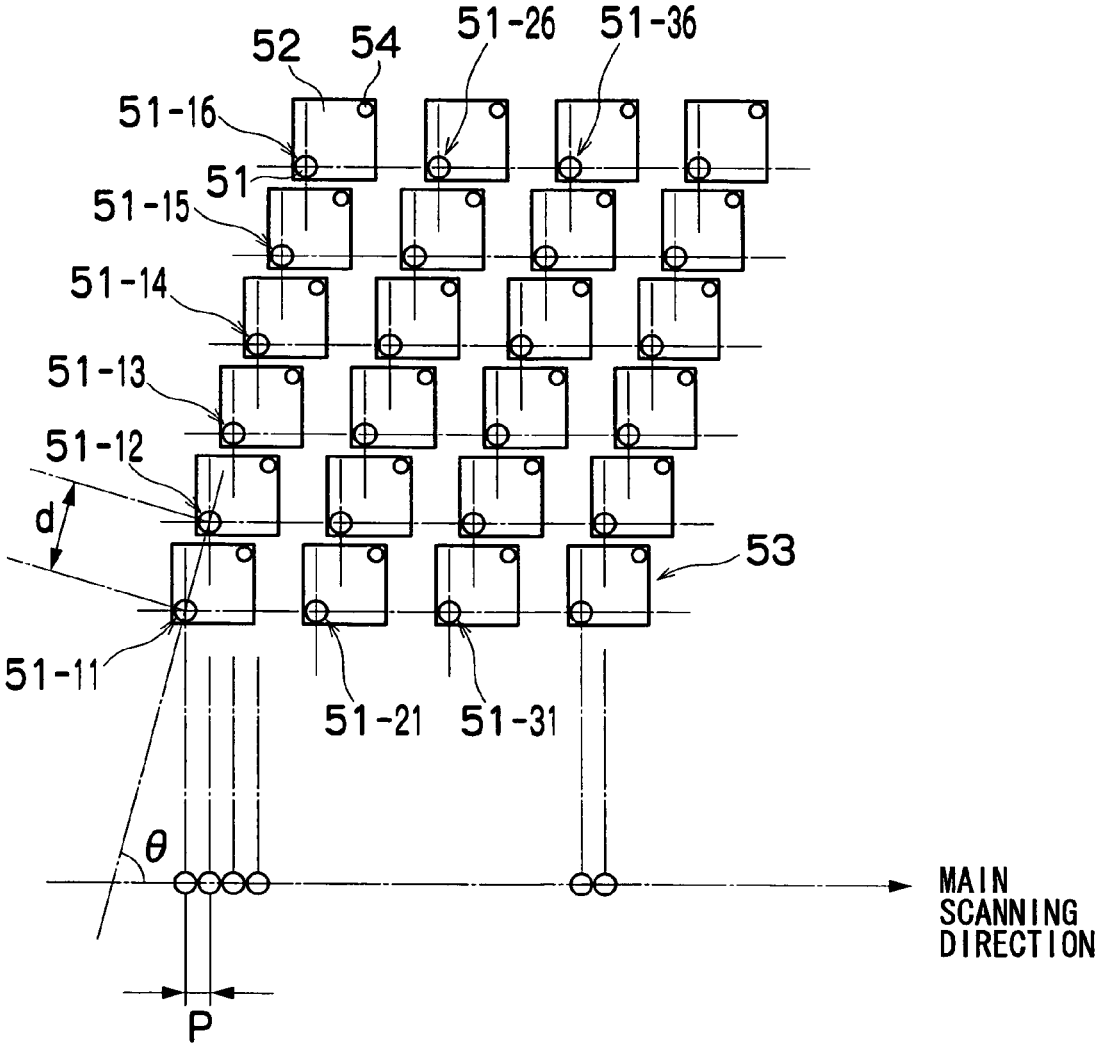
FIG. 4 is an enlarged view showing an embodiment of the nozzle arrangement in the print head shown in FIG. 2.

As shown in FIG. 4, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure in which a plurality of ink chamber units 53 are arranged at a uniform pitch d in a direction having an angle $\theta$ with respect to the main scanning direction, the pitch P of the nozzles projected so as to align in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2400 per inch (2400 nozzles per inch).

In a full-line head comprising rows of nozzles that have a length corresponding to the entire width of the image recordable width, the "main scanning" is defined as printing one line or one strip formed in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 4 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the embodiment illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo method, it is also possible to apply various types of methods, such as a thermal jet method where the ink is heated and bubbles are caused to form therein by means of a heat generating body such as a heater, ink droplets being ejected by means of the pressure applied by these bubbles.

Method for Manufacturing Nozzle Plate

FIGS. 5A to 5E are illustrative diagrams showing steps of manufacturing the nozzle plate 60. Below, the method of manufacturing the nozzle plate 60, which is characteristic of the present invention is described with reference to these diagrams.

Figure 5A:
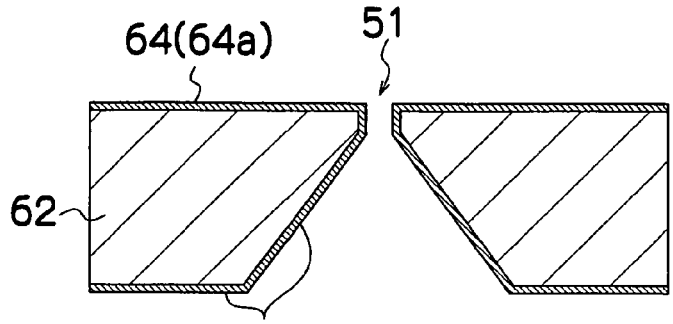
FIGS. 5A to 5E are illustrative diagrams showing steps of manufacturing a nozzle plate.
Figure 6:
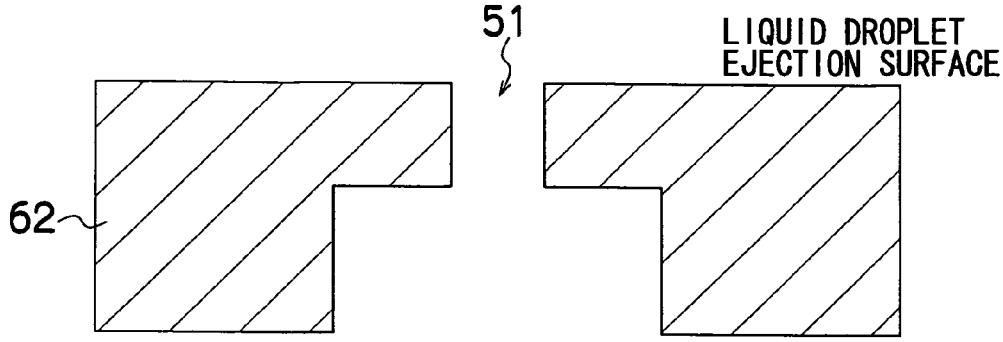
FIG. 6 is an illustrative diagram showing a further mode of the nozzle shape.

Firstly, as shown in FIG. 5A, a liquid-repelling agent is applied to the entire surface of a nozzle plate forming substrate 62, thereby forming a liquid-repelling film 64. The nozzle plate forming substrate 62 is made of stainless steel, nickel, an opaque resin, or the like. Before the application of the liquid-repelling agent, the nozzle plate forming substrate 62 is formed with nozzles 51, which have a substantially circular conical shape (or substantially square conical shape) expanding in size from the front surface (liquid droplet ejection surface) on the liquid droplet ejection side (the upper side in FIG. 5A), toward the rear surface side, which is opposite to the liquid droplet ejection side. Desirably, the nozzles have a substantially circular conical shape or a substantially square conical shape which expands from the liquid droplet ejection surface toward the rear surface side opposite to the liquid droplet ejection surface, but they may also have a straight shape, or a stepped shape as shown in FIG. 6, or another shape which expands from the liquid droplet ejection surface toward the rear surface side opposite to same. On the other hand, a nozzle shape which narrows from the liquid droplet ejection surface toward the opposite side is not desirable. Reference above to "the entire surface" of the nozzle plate forming substrate 62 includes, at least, the front surface and rear surface of the nozzle plate forming substrate 62, and the inner walls of the nozzles. Below, the liquid-repelling film formed on the front surface of the nozzle plate forming substrate 62 is denoted with reference numeral 64*a*, and the liquid-repelling film formed on the rear surface of the nozzle plate forming substrate 62, and the inner walls of the nozzles, is denoted with reference numeral 64*b*.

The liquid-repelling agent used may be an ultraviolet-curable agent, or an agent mixed with an ultraviolet-curable material. In the present embodiment, a liquid-repelling agent in which a photo polymerization agent is mixed with a fluoropolymer having bridging groups is used. The most desirable application method for the liquid-repelling agent is dipping, but it may also be applied by spraying, vapor deposition, bar coating, or spin coating.

The thickness of the nozzle plate forming substrate 62 is 50 μm to 100 μm, the nozzle diameter (the minimum diameter portion on the liquid droplet ejection side) is 10 μm to 30 μm, and the thickness (film thickness) of the liquid-repelling film 64 (64*a*, 64*b*) is 10 μm.

Figure 5B:
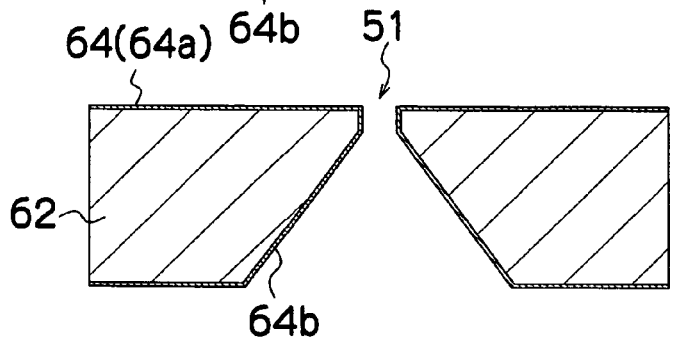

Next, as shown in FIG. 5B, the liquid-repelling film 64 (64*a*, 64*b*) formed on the entire surface of the nozzle plate forming substrate 62 is made to assume a semi-fixed state by drying at a prescribed temperature. During this, the solvent in the liquid-repelling film 64 is removed and the thickness of the liquid-repelling film 64 becomes thinner, compared to the state in FIG. 5A. In the present embodiment, the liquid-repelling film 64 is dried for 5 minutes at 90° C., and the thickness of the liquid-repelling film 64 in the state in FIG. 5B is approximately 1 μm to 3 μm.

Figure 5C:
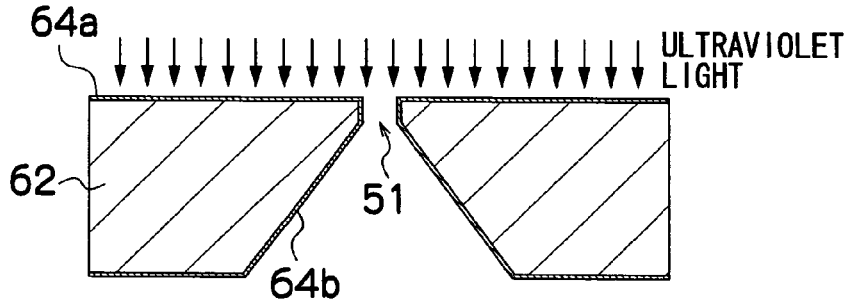

Next, as shown in FIG. 5C, ultraviolet (UV) light is irradiated onto the liquid-repelling film 64*a* on the front surface of the nozzle plate forming substrate 62, from the front surface side (liquid droplet ejection side) of the nozzle plate forming substrate 62. In the present embodiment, ultraviolet light of 500 mJ is irradiated for 10 seconds. Thereby, the liquid-repelling film 64*a* on the front surface of the nozzle plate forming substrate 62 assumes a completely solidified state (fully solidified state). On the other hand, the liquid-repelling film 64*b* on the rear surface of the nozzle plate forming substrate 62 and the inner walls of the nozzles does not receive irradiation of ultraviolet light and therefore it remains in a semi-solidified state.

In the present embodiment, a mode is described in which ultraviolet light is irradiated onto the liquid-repelling agent having properties whereby the agent solidifies when irradiated with ultraviolet light, but the invention is not limited to this, and a mode is also possible, for example, in which an electron beam is irradiated onto a liquid-repelling agent having properties whereby the agent solidifies when irradiated with an electron beam.

Figure 5D:
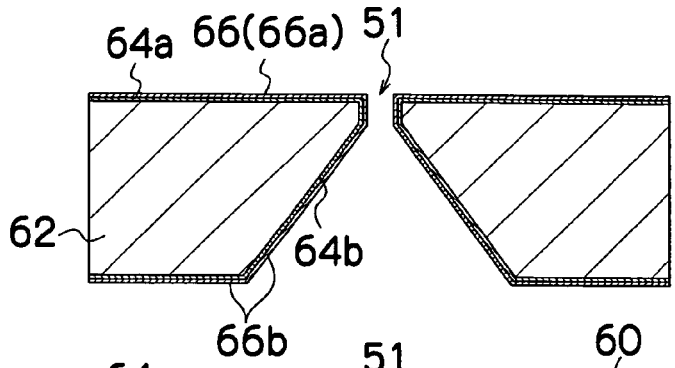

Next, as shown in FIG. 5D, a liquid-philic agent is applied to the entire surface of the nozzle plate forming substrate 62, thereby forming a liquid-philic film 66. As described above, the liquid-repelling films 64*a* and 64*b* have already been formed on the entire surface of the nozzle plate forming substrate 62, and the liquid-philic agent is therefore applied over the liquid-repelling films 64*a* and 64*b*. Thereafter, heat treatment is carried out and the liquid-philic film 66 is solidified. In the present embodiment, heat treatment is carried out for 3 hours at 120° C., and the film thickness of the liquid-philic film 66 is approximately 1.5 μm. Below, the liquid-philic film formed on the liquid-repelling film 64*a* on the front surface of the nozzle plate forming substrate 62 is denoted with reference numeral 66*a*, and the liquid-philic film formed on the liquid-repelling film 64*b* on the rear surface of the nozzle plate forming substrate 62 and the inner walls of the nozzles, is denoted with reference numeral 66*b*.

In the present embodiment, an epoxy type thermosetting resin is used as the liquid-philic agent, but it is also possible to use an adhesive containing $SiO_2$, or the like.

Similarly to the application method for the liquid-repelling agent described above, the most desirable application method for the liquid-philic agent is dipping, but it may also be applied by spraying, vapor deposition, bar coating, or spin coating.

On the front surface of the nozzle plate forming substrate 62, there is low adhesion between the liquid-repelling film 64*a* and the liquid-philic film 66*a* and hence the liquid-philic film 66*a* can peel away readily from the liquid-repelling film 64*a*, whereas on the rear surface of the nozzle plate forming substrate 62 and the inner walls of the nozzles, there is high adhesion between the liquid-repelling film 64*b* and the liquid-philic film 66*b* and hence the liquid-philic film 66*b* is less liable to peel away than at the front surface. This difference is due to the difference in the states of solidification of the liquid-repelling films 64*a* and 64*b* (namely, between the fully solidified state and the semi-solidified state). The states of the liquid-philic films 66*a* and 66*b* formed on the liquid-repelling films 64*a* and 64*b* are described in detail later with reference to FIGS. 7 to 9.

Figure 5E:
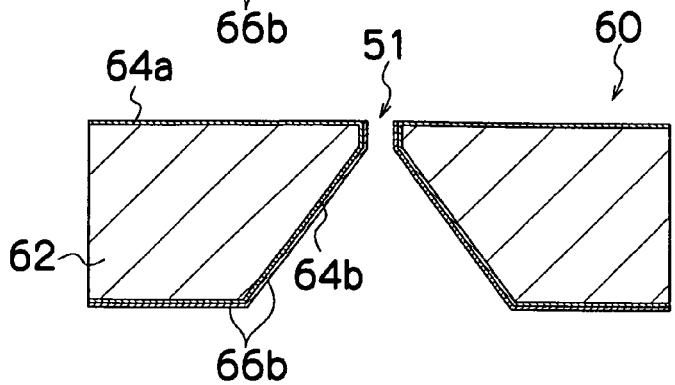

Finally, as shown in FIG. 5E, the liquid-philic film 66*a* (see FIG. 5D) on the front surface of the nozzle plate forming substrate 62 is removed. For example, the liquid-philic film 66*a* is removed by ultrasonic washing with alcohol, or the like. During this, the liquid-philic film 66*b* on the rear surface of the nozzle plate forming substrate 62 and the inner walls of the nozzles does not peel away from the liquid-repelling film 64*b*, since it has good adhesion with the liquid-repelling film 64*b*. In this way, it is possible to manufacture the nozzle plate 60 in which the liquid-repelling film 64*a* is formed on the front surface of the nozzle plate forming substrate 62, and the liquid-philic film 66*b* is formed on the rear surface of the substrate 62 and on the inner walls of the nozzles.

Next, the states of the liquid-philic films 66*a* and 66*b* formed on the liquid-repelling films 64*a* and 64*b* are described in detail with reference to FIGS. 7 to 9.

Figure 7:
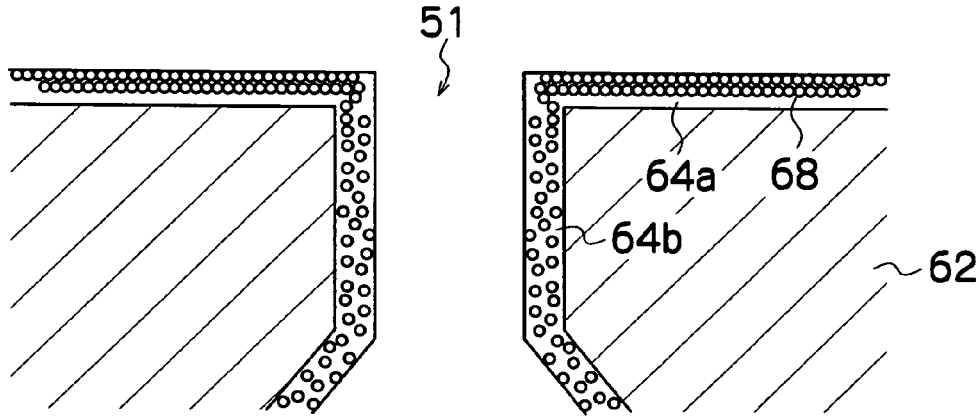
FIG. 7 is an enlarged diagram of the periphery of the nozzle shown in FIG. 5C.

FIG. 7 is an enlarged diagram of the periphery of the nozzle shown in FIG. 5C, and shows a state after ultraviolet light has been irradiated from the side of the front surface of the nozzle plate forming substrate 62 (the liquid droplet ejection side). As shown in FIG. 7, due to the irradiation of ultraviolet light, in the liquid-repelling film 64*a* on the front surface of the nozzle plate forming substrate 62 (the upper surface in FIG. 7), the polymer 68 (the fluoropolymer having bridging groups in the present embodiment) contained in the liquid-repelling film 64*a* increases in density, and assumes a fully solidified state on the front surface side of the liquid-repelling film 64*a* (namely, the side distant from the nozzle plate forming substrate 62). Consequently, the liquid repelling characteristics are increased at the front surface of the liquid-repelling film 64*a*. On the other hand, the liquid-repelling film 64*b* on parts other than the front surface of the nozzle plate forming substrate 62 (in FIG. 7, only the liquid-repelling film 64*b* on the inner walls of the nozzle is shown) do not receive irradiation of ultraviolet light, and therefore they assume a semi-solidified state in which the polymer 68 is dispersed.

Figure 8:
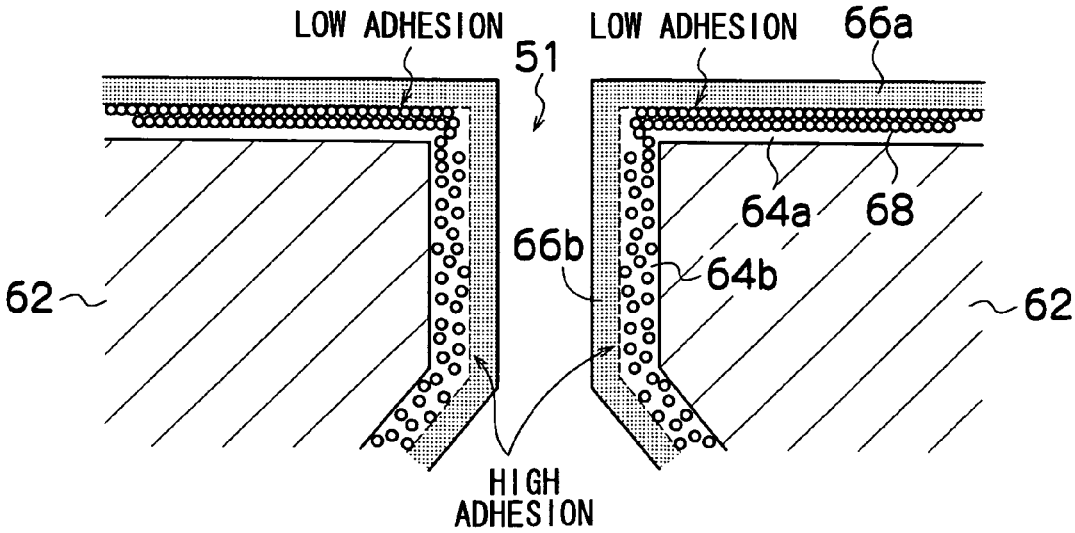
FIG. 8 is an enlarged diagram of the periphery of the nozzle shown in FIG. 5D.

FIG. 8 is an enlarged diagram of the periphery of the nozzle in FIG. 5D, and shows a state in which the liquid-philic films 66*a* and 66*b* are formed on the liquid-repelling films 64*a* and 64*b*. As shown in FIG. 8, on the front surface of the nozzle plate forming substrate 62, the adhesion of the liquid-philic film 66*a* to the liquid-repelling film 64*a* is reduced due to the fact that the liquid-repelling film 64*a* is in the solidified state. On the other hand, on the parts other than the front surface of the nozzle plate forming substrate 62, the adhesion of the liquid-philic film 66*b* to the liquid-repelling film 64*b* is increased, due to the fact that the liquid-repelling film 64*b* is in the semi-solidified state.

Figure 9:
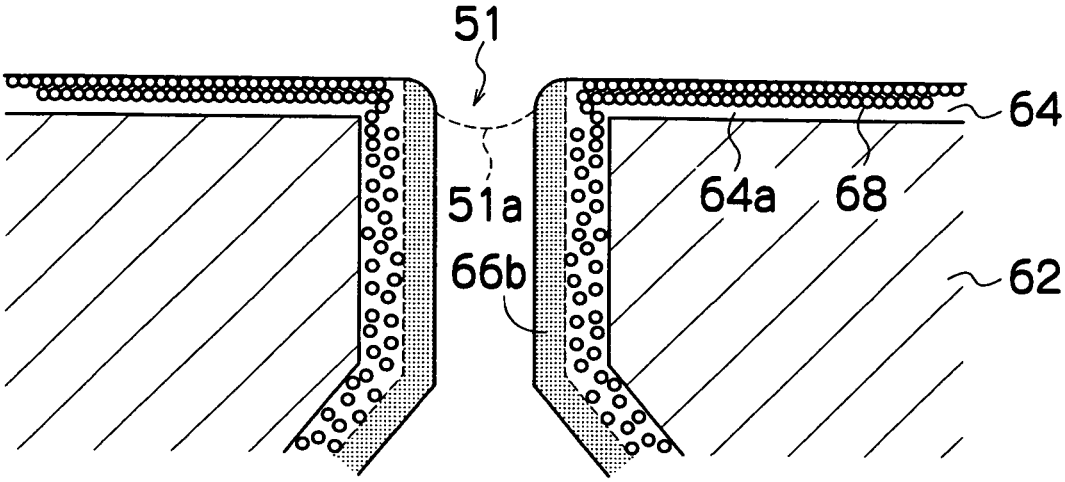
FIG. 9 is an enlarged diagram of the periphery of the nozzle shown in FIG. 5E.

FIG. 9 is an enlarged diagram of the periphery of the nozzle shown in FIG. 5E, and shows a state after the liquid-philic film 66*a* on the front surface of the nozzle plate forming substrate 62 has been removed. Due to the differences in adhesion described above, as shown in FIG. 9, the liquid-philic film 66*a* on the front surface of the nozzle plate forming substrate 62 is removed, whereas the liquid-philic film 66*b* on the parts other than the front surface is not removed. This liquid-philic film 66*b* is formed up to the vicinity of the opening of the nozzle 51, and in particular, up to the vicinity of the meniscus part 51*a* (indicated by the broken line in FIG. 9) in the nozzle 51. The liquid-philic film 66*b* can be formed in this way by solidifying the liquid-repelling film 64*a* on the front surface of the nozzle plate forming substrate 62, by utilizing the photo polymerization reaction caused by the irradiation of ultraviolet light shown in FIG. 5C. Furthermore, although not shown in the drawings, with the method using the photo polymerization reaction, it is also possible to form the liquid-philic film 66*b* in a substantially uniform fashion between the plurality of nozzles 51.

As described above, in the method of manufacturing the nozzle plate according to the present embodiment, there is no step for removing the liquid-repelling film and since resist is not used, neither is there a step for removing resist. Therefore, the manufacturing process is simplified in comparison with a method of manufacture in the related art.

Furthermore, in the nozzle plate manufactured by this method of manufacture, the liquid-philic film formed on the inner sides of the nozzles is substantially uniform between the plurality of nozzles, and therefore, ink ejection characteristics and ink supply performance are improved and the back pressure can be controlled more easily in a print head having this nozzle plate.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a nozzle plate, comprising:

a liquid-repelling film forming step of forming a liquid-repelling film on an entire surface of a nozzle plate forming substrate having been formed with nozzles for ejecting liquid droplets;

a liquid-repelling film solidification step of solidifying the liquid-repelling film formed in the liquid-repelling film forming step on a liquid droplet ejection surface of the nozzle plate forming substrate;

a liquid-philic film forming step of forming a liquid-philic film on the liquid-repelling film formed on the entire surface of the nozzle plate forming substrate, after the liquid-repelling film solidification step;

a liquid-philic film solidification step of solidifying the liquid-philic film formed in the liquid-philic film forming step; and a liquid-philic film removal step of removing the liquid-philic film formed on the liquid-repelling film on the liquid droplet ejection surface of the nozzle plate forming substrate, after the liquid-philic film solidification step.

2. The method as defined in claim 1, wherein:

the liquid-repelling film has a property of solidifying when irradiated with radiation;

the liquid-repelling film solidification step includes a step of solidifying the liquid-repelling film by irradiating the radiation onto the liquid-repelling film formed on the liquid droplet ejection surface of the nozzle plate forming substrate; and the liquid-philic film solidification step includes a step of thermally curing the liquid-philic film formed on the liquid-repelling film.

3. The method as defined in claim 2, wherein the liquid-repelling film solidification step includes a step of causing the liquid-repelling film formed on the liquid droplet ejection surface of the nozzle plate forming substrate to assume a semi-solidified state, and then changing the liquid-repelling film to a fully solidified state by irradiating the radiation onto the liquid-repelling film.

4. A nozzle plate, comprising:

a nozzle plate forming substrate which has nozzles for ejecting liquid droplets;

a liquid-repelling agent which is applied on an entire surface of the nozzle plate forming substrate, the liquid-repelling agent being in a fully solidified state on a liquid droplet ejection surface side of the nozzle plate forming substrate and being in a semi-solidified state on a surface of the nozzle plate forming substrate opposite to the liquid droplet ejection surface and on inner walls of the nozzles; and a liquid-philic film which is formed on the semi-solidified liquid-repelling agent on the surface opposite to the liquid droplet ejection surface and on the inner walls of the nozzles.

5. A liquid ejection head, comprising the nozzle plate as defined in claim 4.

6. An image forming apparatus, comprising the liquid ejection head as defined in claim 5.

* * * * *